US011472626B2

(12) United States Patent
Morris

(10) Patent No.: US 11,472,626 B2
(45) Date of Patent: Oct. 18, 2022

(54) MULTI-COMPARTMENT CONTAINER HOLDER

(71) Applicant: Chewler, LLC, Lincoln, NE (US)

(72) Inventor: Landon L. Morris, Lincoln, NE (US)

(73) Assignee: Chewler LLC, Lincoln, NE (US)

( * ) Notice: Subject to any disclaimer, the term of this patent is extended or adjusted under 35 U.S.C. 154(b) by 154 days.

(21) Appl. No.: 16/852,655

(22) Filed: Apr. 20, 2020

(65) Prior Publication Data

US 2020/0339338 A1 Oct. 29, 2020

Related U.S. Application Data

(60) Provisional application No. 62/837,983, filed on Apr. 24, 2019.

(51) Int. Cl.

| | |
|---|---|
| ***B65D 81/38*** | (2006.01) |
| ***B65D 81/32*** | (2006.01) |
| ***B65D 25/04*** | (2006.01) |

(52) U.S. Cl.

CPC ..... *B65D 81/3886* (2013.01); *B65D 25/04* (2013.01); *B65D 81/3205* (2013.01); *B65D 81/3879* (2013.01); *B65D 2203/02* (2013.01); *B65D 2313/04* (2013.01)

(58) Field of Classification Search

CPC ..... B65D 81/3205; B65D 81/3876; B65D 81/3879; B65D 2313/04; B65D 2303/00; B65D 2251/04; A47G 2023/0283

See application file for complete search history.

(56) References Cited

U.S. PATENT DOCUMENTS

| | | | | |
|---|---|---|---|---|
| 4,383,422 | A | 5/1983 | Gordon | |
| 4,399,668 | A | 8/1983 | Williamson | |
| 4,534,391 | A | 8/1985 | Ventimiglia | |
| 4,561,563 | A | 12/1985 | Woods | |
| 6,019,245 | A | 2/2000 | Foster | |
| 6,164,487 | A | 12/2000 | Hicks | |
| 6,530,232 | B1 | 3/2003 | Kitchens | |
| 6,571,976 | B1 * | 6/2003 | Sonnabend | B65D 25/24 220/483 |
| 6,655,543 | B2 | 12/2003 | Beuke | |
| 8,002,143 | B2 | 8/2011 | Vorderkunz | |
| 8,365,960 | B1 | 2/2013 | Kalaouze | |
| D701,079 | S | 3/2014 | Arora | |

(Continued)

FOREIGN PATENT DOCUMENTS

KR 200474398 Y1 * 9/2014

*Primary Examiner* — Mollie Impink

(74) *Attorney, Agent, or Firm* — Law Office of Mark Brown, LLC; Mark E. Brown

(57) ABSTRACT

A multi-compartment insulated container holder includes a body with an upper section for a beverage container or vessel and a lower section configured for receiving a personal item, such as a smokeless tobacco product container. The upper and lower sections are magnetically connected. The upper and lower sections include sidewall extensions with alignment faces, which align upper and lower magnets with the container holder in a closed configuration. The lower section includes multiple pillar wedges in radially-spaced relation on an inner perimeter of a lower section sidewall. The pillar wedges are configured for engaging and releasably retaining a cylindrical container in the lower section compartment.

4 Claims, 3 Drawing Sheets

(56) References Cited

U.S. PATENT DOCUMENTS

| | | | | |
|---|---|---|---|---|
| 9,420,908 | B1 | 8/2016 | White | |
| 9,615,684 | B2 | 4/2017 | Deakin | |
| 11,178,986 | B2 * | 11/2021 | Maynard | A47G 1/1633 |
| 2004/0007553 | A1 * | 1/2004 | Smolko | A47G 19/2266 215/12.1 |
| 2004/0232156 | A1 | 11/2004 | Hogan et al. | |
| 2005/0279751 | A1 | 12/2005 | Dempsy | |
| 2010/0005828 | A1 | 1/2010 | Fedell | |
| 2014/0061208 | A1 | 3/2014 | Boyd | |
| 2015/0021346 | A1 | 1/2015 | Cappuccio | |
| 2015/0096324 | A1 | 4/2015 | Marchiori | |
| 2016/0150902 | A1 * | 6/2016 | Dokhanian | A47G 19/2205 220/739 |

* cited by examiner

MULTI-COMPARTMENT CONTAINER HOLDER

CROSS-REFERENCE TO RELATED APPLICATION

This application claims priority in U.S. Provisional Patent Application No. 62/837,983, filed Apr. 24, 2019, which is incorporated herein by reference.

BACKGROUND OF THE INVENTION

1. Field of the Invention

The present invention relates generally to container holders, and particularly to a multi-compartment, insulative holder for cans, bottles, accessories and personal items.

2. Description of the Related Art

Insulative holders for containers, such as cans and bottles of beverages, function to retain the coldness (or heat) of the container contents. Moreover, they provide impact-cushioning protection for the containers. The insulative holders can be mass-produced by molding from a variety of thermoplastic elastomer (TPE) materials, which are chosen for their thermal insulative and elastic properties. Cans and bottles are inserted into the open-ended holders and can be removably retained therein by friction between the close-fitting container and holder surfaces.

Personal items are often conveniently stored and transported in apparel pockets, handbags and the like. The present invention enhances the benefits of a prior art insulative container holder by providing an integral, easily-accessible compartment for personal items. For example, smokeless tobacco products, e.g., chewing tobacco and snuff, are commonly packaged in cylindrical containers with diameters similar to common beverage containers. Containers with diameters in the range of about two to three inches are commonly used for beverages and smokeless tobacco products. The multi-compartment container holder of the present invention can accommodate various other personal items, such as cash, credit cards, debit cards, keys, medications, sunscreen lotion) or personal care items. Combining storage for such a range of items would accommodate individuals engaged in various activities such as sports, exercise, travel, etc. Moreover, recreational activities at swimming pools, beaches and other venues would be enhanced by the usefulness and convenience of the present invention.

Heretofore there has not been available a combined multi-compartment holder with the advantages and features of the present invention.

SUMMARY OF THE INVENTION

A multi-compartment container holder includes a generally cylindrical body with upper and lower sections. The upper section includes a sidewall with an open upper end through which containers and vessels can be inserted and retracted. The lower section defines a compartment, which can be opened and closed for removably storing items. The upper and lower sections can be magnetically coupled for easy assembly and disassembly. The exterior of the body includes an inset defining a label area for receiving commercial messaging, images, personal identification and other content.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
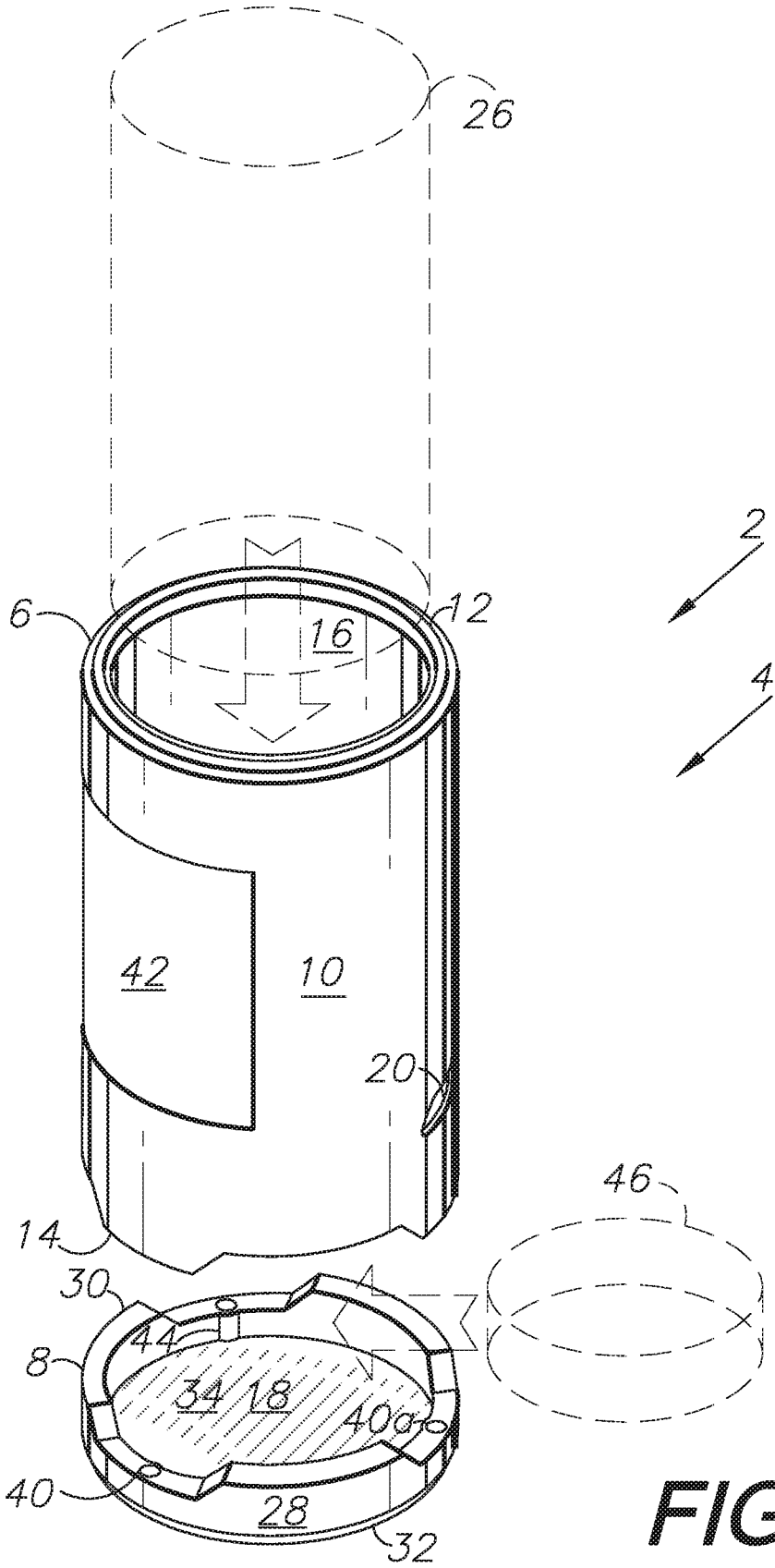
FIG. 1 is an upper, perspective view of a multi-compartment container holder comprising an aspect of the present invention, shown receiving a beverage container and a smokeless tobacco container.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Said terminology will include the words specifically mentioned, derivatives thereof and words of similar meaning.

II. Multi-Compartment Container Holder 2

The container holder 2 generally comprises a tubular body 4 with upper and lower sections 6, 8. The upper body section 6 includes a generally cylindrical sidewall 10 at the outside surface of the body 4 and extending between top and bottom ends 12, 14. A relatively deep upper section container receiver 16 can be configured to receive a beverage container or vessel 26, e.g., a can, bottle, glass or cup. The upper body section 6 also includes a relatively shallow bottom receiver 18 open downwardly at the wall lower end 14. A circular panel 22 defines a closed bottom of the receiver 18. One or more vents 20 extend through the side wall 10 in proximity to the panel 22 and facilitate insertion and removal of a close-fitting container (shown in dashed lines), e.g., by breaking a vacuum created by the close-fitting surfaces. Moreover, the vent or vents 20 enable the container receiver 16 to drain.

Figure 2:
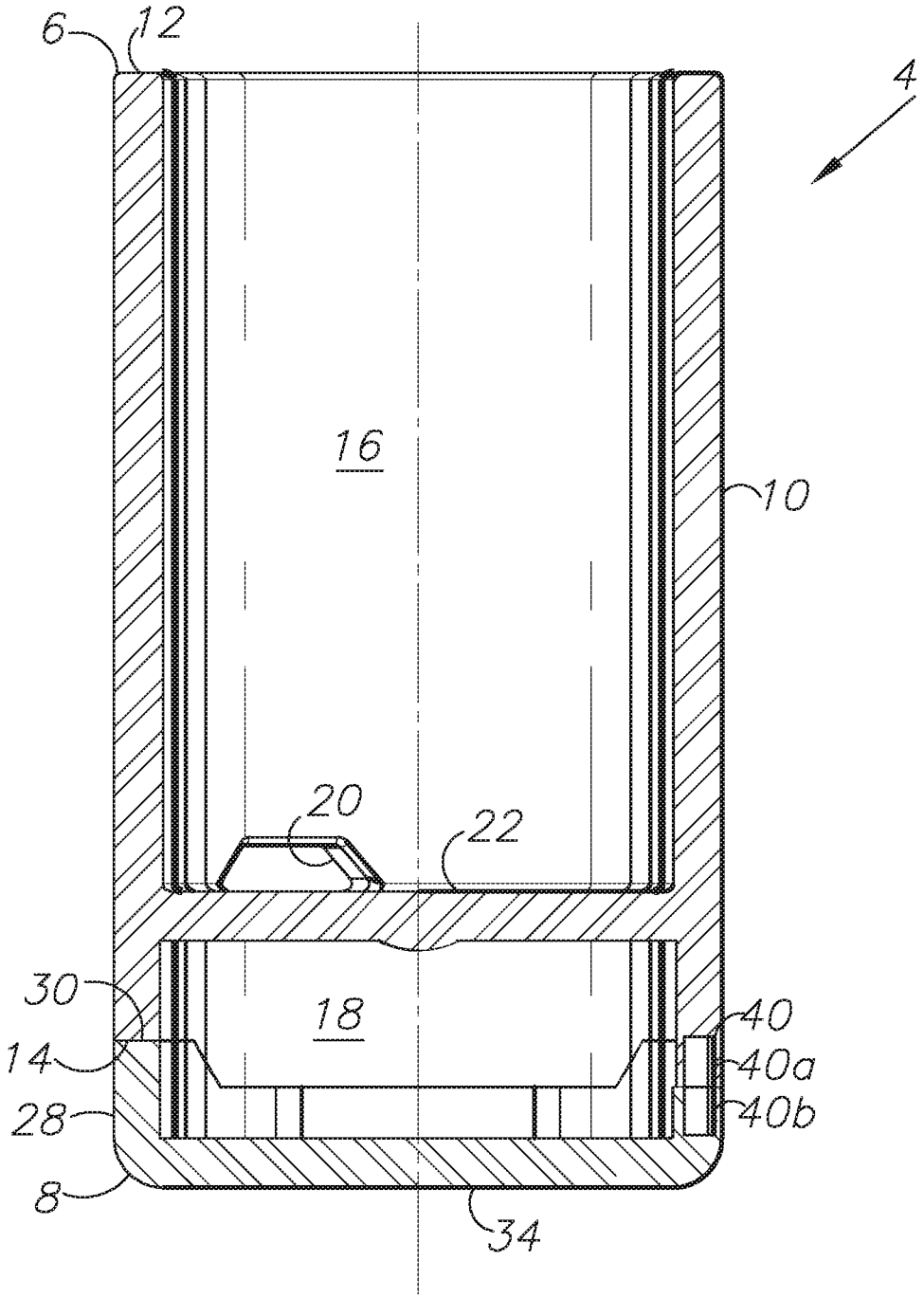
FIG. 2 is a vertical, cross-sectional view thereof, particularly showing the upper and lower sections magnetically coupled.
Figure 3:
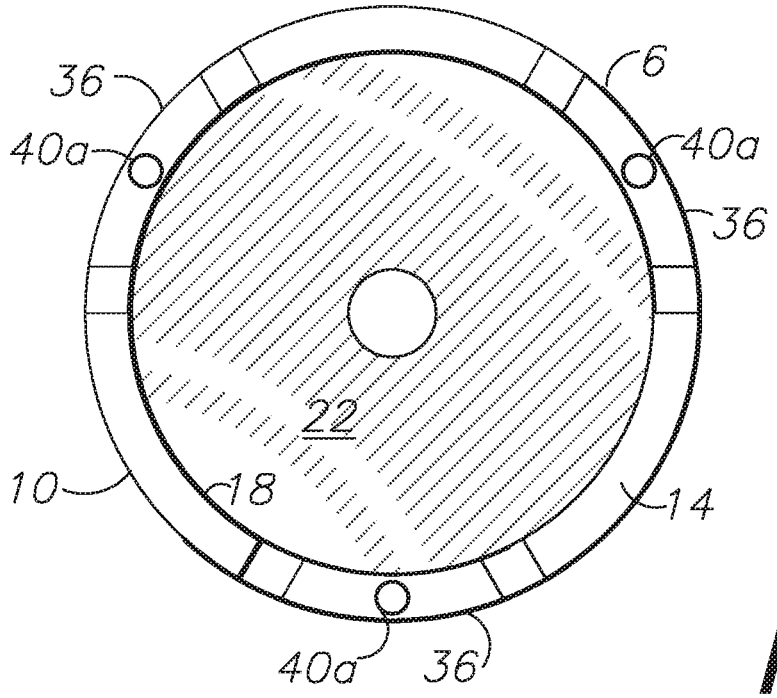
FIG. 3 is a bottom plan view of the upper section.
Figure 4:
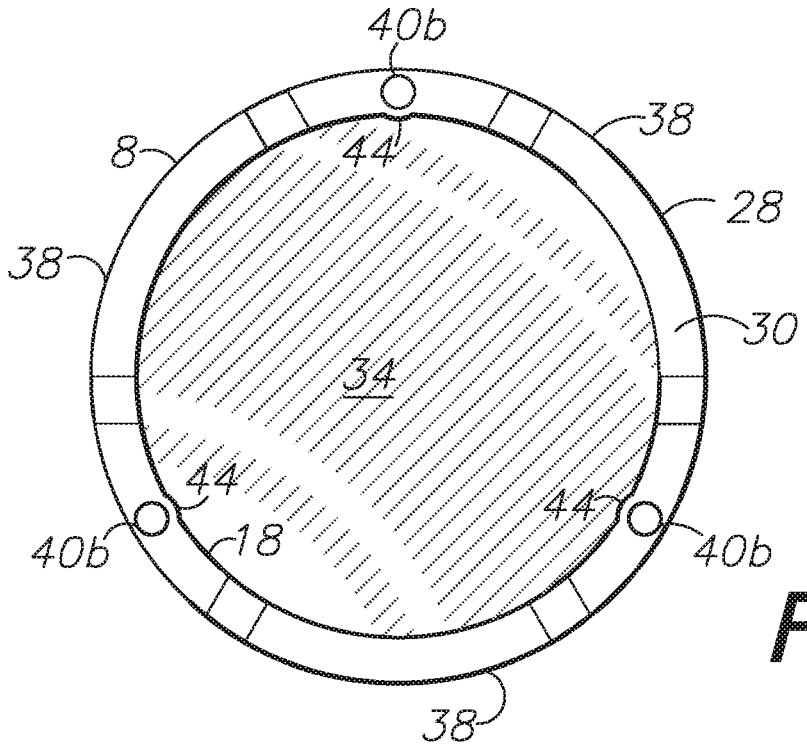
FIG. 4 is a top plan view of the lower section.

The body lower section 8 includes a generally cylindrical sidewall 28, which aligns with the upper section sidewall 10 with the container holder 2 assembled (FIG. 2). The lower section sidewall 28 includes upper and lower ends 30, 32. A circular panel 34 closes the lower section 8 sidewall lower end 32.

The body upper and lower sections 6, 8 are configured for releasable, magnetic attachment. The lower end 14 of the upper section sidewall 10 and the upper end 30 of the lower section sidewall 28 include corresponding, interlocking extensions (FIG. 1) 36, 38, respectively. The interlocking extensions 36, 38 function to accurately align the upper and lower sections 6, 8 whereby magnetic attachment assemblies 40 with upper and lower magnets 40*a*, 40*b* of magnet assemblies 40 aligned for releasable attachment.

The body 4 is preferably fabricated from a thermoplastic elastomer (TPE) material. Among the acceptable TPE materials is Santoprene™ thermoplastic vulcanizate (TPV), which is a fully dynamically vulcanized ethylene propylene diene monomer. Other materials with insulative properties, including Styrofoam expanded polystyrene and foam rubber, can also be utilized for forming the body 4.

The body exterior can receive graphic and aesthetic content printed, silk-screened, debossed or embossed thereon, e.g., in the optional rectangular body surface inset 42. Alternatively, a label can be applied in the body surface inset 42. Various stickers and other materials can also be applied to the body 4.

The body lower section 8 includes pillar wedges 44 regularly spaced around the perimeter of the bottom compartment 18. For example, the pillar wedges 44 can be located to the inside of the lower magnets 40*b*. The pillar wedges 44 function to removably retain an object, such as a smokeless tobacco container 46, in place and further to provide an extra impact-cushioning space within the compartment 18.

It is to be understood that the invention can be embodied in various forms and is not to be limited to the examples specifically discussed above. The range of components and configurations which can be utilized in the practice of the present invention is virtually unlimited.

Having thus described the invention, what is claimed as new and desired to be secured by Letters Patent is:

1. A multi-compartment container holder for a beverage container and a cylindrical container, the holder including:

an upper section including an upper end and a lower end, a sidewall, a receiver open at said upper end and an upper circular panel closing said receiver between said upper and lower ends;

said receiver configured for receiving a beverage container;

said upper section lower end including multiple, radially-spaced extensions with sloping alignment faces and including multiple radially-spaced embedded magnet assemblies;

a lower section including an upper end and a lower end, a sidewall, a compartment open at said lower section upper end and a lower circular panel at said lower section lower end closing a bottom of said compartment;

said lower section upper end including multiple, radially-spaced extensions with sloping lower section extension alignment faces;

said lower section including multiple pillar wedges in radially-spaced relation on an inner perimeter of said lower section sidewall, each of said pillar wedges including an embedded magnet configured for engaging said upper section embedded magnets to releasably retain said cylindrical container in said lower section compartment;

each pillar wedge terminating at an upper end that is flush with said lower section upper end;

said lower section configured to hold said cylindrical container such that said cylindrical container extends above said lower section upper end and allows opening and closing of said cylindrical container with said cylindrical container retained in said lower section compartment; and said upper and lower section extension alignment faces configured for aligning said embedded magnets of said upper and lower sections when said lower section compartment is in said closed configuration.

2. The container holder according to claim 1 wherein said body is fabricated from an insulative, resilient material.

3. The container holder according to claim 2 wherein said body is fabricated from a material, comprising one of a thermoplastic elastomer (TPE), foam rubber or expanded polystyrene material.

4. The container holder according to claim 3 wherein said body is fabricated from a TPE material comprising thermoplastic vulcanizate (TPV) dynamically vulcanized ethylene propylene diene monomer.

* * * * *